US005407588A

United States Patent [19]

Butterworth et al.

[11] Patent Number: 5,407,588

[45] Date of Patent: Apr. 18, 1995

[54] FABRIC SOFTENING COMPOSITION

[75] Inventors: Robert M. Butterworth, Heidelberg, Germany; Kenwyn D. Saunders, Ho Ho Kus, N.J.

[73] Assignee: Lever Brothers Company, Division of Conopco, Inc., New York, N.Y.

[21] Appl. No.: 23,166

[22] Filed: Feb. 19, 1993

Related U.S. Application Data

[63] Continuation of Ser. No. 847,837, Mar. 9, 1992, abandoned, which is a continuation of Ser. No. 486,028, Feb. 27, 1990, abandoned.

[30] Foreign Application Priority Data

Mar. 2, 1989 [GB] United Kingdom ..... 8904749

[51] Int. Cl.[6] ..... D06M 15/00

[52] U.S. Cl. ..... 252/8.6; 252/8.8; 252/8.9

[58] Field of Search ..... 252/8.6, 8.7, 8.75, 252/8.8, 8.9

[56] References Cited

U.S. PATENT DOCUMENTS

| | | | |
|---|---|---|---|
| 4,102,795 | 7/1978 | Minegishi et al. | 252/8.9 |
| 4,308,024 | 12/1981 | Wells | 8/137 |
| 4,521,328 | 6/1985 | Seibert et al. | 252/174.21 |
| 4,642,258 | 2/1987 | Majewski et al. | 428/68 |
| 4,774,017 | 9/1988 | Seibert et al. | 242/174.12 |
| 4,859,350 | 8/1989 | Gillberg-LaFore | 252/8.6 |
| 4,885,102 | 12/1989 | Yamamura et al. | 252/8.8 |
| 4,915,855 | 4/1990 | Gillberg-LaFore | 252/8.6 |
| 4,937,008 | 6/1990 | Yamamura et al. | 252/8.8 |
| 5,080,830 | 1/1992 | Damaso | 252/547 |

FOREIGN PATENT DOCUMENTS

| | | |
|---|---|---|
| 51983 | 5/1982 | European Pat. Off. . |
| 095580 | 7/1983 | European Pat. Off. . |
| 88718 | 9/1983 | European Pat. Off. . |
| 299787 | 7/1988 | European Pat. Off. . |
| 63/245497 | 10/1988 | Japan . |

*Primary Examiner*—Paul Lieberman
*Assistant Examiner*—Michael P. Tierney
*Attorney, Agent, or Firm*—A. Kate Huffman

[57] ABSTRACT

An aqueous fabric conditioning composition comprising a fabric softener and a polymeric thickening material, said material comprising molecules with a hydrophilic backbone and at least two hydrophobic groups per molecule attached to the hydrophilic backbone, with the proviso that the polymeric material is not a hydrophobically modified nonionic cellulose ether.

2 Claims, No Drawings

FABRIC SOFTENING COMPOSITION

This is a Continuation of Ser. No. 07/847,837, filed Mar. 9, 1992, abandoned, which is a Continuation of Ser. No. 07/486,028 filed Feb. 27, 1990, abandoned.

FIELD OF THE INVENTION

This invention relates to a fabric softening composition and to a process for treating fabrics therewith. Fabric softening compositions are used in textile finishing and laundering processes to impart properties such as softness and a pleasant feel or "handle" to fabrics, and are used particularly in the rinse stage of the laundering process immediately after the laundry articles have been washed in a washing machine.

BACKGROUND OF THE INVENTION

A large number of proposals has been made for the formulation of fabric softening compositions, most of these involving the use of an aqueous dispersion of a cationic surfactant, for instance a quaternary ammonium salt or an imidazolinium salt, as the active component or as part of it. It is known from U.S. Pat. No. 4,308,024 corresponding to GB-A-2039556 that fabric softening compositions can be formulated to comprise a dispersion of cationic surfactant together with free fatty acid which functions as a nonionic surfactant.

The above compositions based on dispersions of cationic surfactants are non-Newtonian in character. In compositions intended for use by consumers in the home the viscosity (or strictly the apparent viscosity) of the composition is an important factor in its acceptability to the consumer, the more viscous compositions being perceived as being of higher quality than the more mobile ones. Manufacturers therefore attempt to produce a product which is as viscous as possible without being so viscous that problems are created elsewhere, such as in pouring or dispensing characteristics. In compositions intended for automated dispensing in washing machines, a low but tightly controlled viscosity is desirable, which again is difficult to achieve if the composition behaves unpredictably during manufacture and subsequent ageing.

U.S. Pat. No. 4,379,059 corresponding to EP-51983 discloses a process for the manufacture of a shear-thinning fabric softening composition, with good control of final viscosity, comprising the steps of sequentially or simultaneously:

(i) forming an aqueous dispersion of a cationic surfactant, having a viscosity less than the final viscosity; and (ii) thickening the composition to the final viscosity with a nonionic or weakly anionic polymeric thickener. The thickener is selected from guar gum, polyvinylacetate, polyacrylamide, or a mixture of guar gum and xanthan gum containing no more than 10% by weight of xanthan gum. The polyacrylamides which are specifically referred to are the less anionic polyacrylamides. Quaternised guar gum was stated to be unsuitable.

The essence of the process of EP-51983 corresponding to U.S. Pat. No. 4,379,059 is to form a dispersion which is less viscous than is desired, and then thicken it with a polymeric thickener.

We have now found that a further class of polymeric materials is especially suitable as a thickener for fabric conditioning compositions. These materials provide dispersions the viscosity of which is relatively stable, and which do not bring with them any disadvantage which would make the product unsatisfactory for treating fabrics.

DETAILED DESCRIPTION OF PREFERRED EMBODIMENTS

These thickeners are polymeric substances comprising a hydrophilic backbone and at least two hydrophobic moieties per molecule.

Accordingly the present invention relates to an aqueous fabric conditioning composition comprising a fabric softener and a polymeric material, said material comprising molecules with a hydrophilic backbone and at least two hydrophobic groups per molecule attached to the hydrophilic backbone, with the proviso that the polymeric material is not a hydrophobically modified nonionic cellulose ether.

For the purpose of this invention only combinations of softener materials and polymers are claimed which have a higher viscosity in the presence of the polymer than in the absence of the polymer. It is believed that only polymeric molecules having at least two hydrophobic moieties contribute to the thickening effect. For practical purposes, however, generally a reaction mixture of polymeric molecules will be used, in that case it is not necessary that in such a mixture the molecules contain on average two hydrophobic moieties; satisfactory results can also be obtained when the average is less than two, provided that a significant part of the molecules comprise two or more hydrophobic moieties. It is however preferred that polymeric reaction mixtures are used which comprise on average two or more hydrophobic moieties per molecule.

Preferably the number of hydrophobic groups attached to the hydrophilic backbone is relatively small. Preferably the hydrophobic groups constitute less than 5% by weight of the polymer, more preferred between 0.5 and 2% by weight of the polymer. These relatively small numbers of hydrophobic groups ensure that the molecules remain relatively water soluble. Preferred polymeric thickeners according to the invention have a solubility in water at 25° C. of more than 0.01% by weight, preferably more than 0.5% by weight, most preferred between 0.5 and 25% by weight.

Preferred hydrophobic groups are linear or branched alkyl or alkenyl groups, preferably having a chain length of less than 40, more preferably between 8 and 24 carbon atoms.

The polymeric thickeners for use in fabric conditioners according to the invention preferably have a nonionic or cationic hydrophilic backbone. Preferably the polymeric thickeners are hydrophobically modified nonionic polymers.

Preferred hydrophobically modified nonionic polymers are based on polyoxyalkylene or polyvinylalcohol hydrophilic backbones, to which a small number of alkyl groups have been attached. Examples of these materials are:

(i) copolymers of ethylene oxide and/or propylene oxide with small amounts of $C_8$–$C_{24}$ side chains, for instance having the basic formula:

$$HO-\underbrace{(CH_2CH_2O)_n(C_pH_{2p}CH_2O)_m}_{R_3}-\underset{\underset{R_2}{|}}{CH}CH_2OH$$

(ii) Hydrophobically modified poly (ethylene oxide and/or propylene oxide/urethanes) for instance of the following formula:

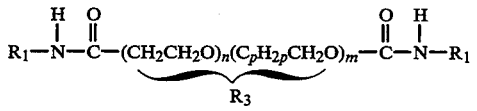

(iii) alkyl substituted poly (vinyl) alcohols, for instance of the following formula:

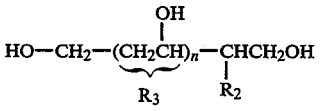

Wherein:

p=1 to 4 preferably 1 or 2 n+m=greater than 10 m=If p is greater than 1, m is such that the group involved constitutes less than 50 mole %, preferably less than 25 mole % of the polymer.

$R_1$=a $C_8$–$C_{24}$ linear or branched alkyl or alkenyl $R_2$=hydrogen or a $C_8$–$C_{24}$ linear or branched alkyl or alkenyl $R_3$=a minimum of two $R_1$ groups which can be substituted at any $CH_2$ group along the polymer backbone.

Hydrophobically modified poly (ethylene oxide and/or propylene oxide/urethanes) according to formula (ii) are marketed by UNION CARBIDE under the UCAR SCT trademark for the thickening of latex systems and generally have a molecular weight in the region of 40,000. Up till now it has not been recognised that these materials can advantageously be incorporated in fabric conditioning systems which are of a totally different nature than the latex systems in which the materials have been incorporated up till now.

Also a surprising aspect of the present invention is that the level of thickener material, necessary to obtain the desired thickening effect is far less when using a polymeric material as now claimed for use in softener systems than by using other thickener materials which have up till now been used for the thickening of fabric conditioning compositions.

Depending upon the viscosity required, the polymeric material will be present in the composition of the invention in an amount of from 0.008 to 0.80% by weight, preferably from 0.01 to 0.30% by weight of the composition.

The preferred molecular weight of the thickener materials to be used is preferably above 15,000 more preferred from 20,000 to 1,000,000 more preferred from 25,000 to 100,000, especially preferred from 30,000 to 70,000.

The fabric softener for use in the fabric conditioning composition according to the invention can be any fabric substantive cationic, nonionic or amphoteric material suitable for softening fabrics.

Preferably the softening material is a cationic material which is water-insoluble in that these materials have a solubility in water at pH 2.5 and 20° C. of less than 10 g/l. Highly preferred materials are cationic quaternary ammonium salts having two C12-24 hydrocarbyl chains.

Well-known species of substantially water-insoluble quaternary ammonium compounds have the formula

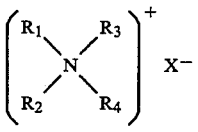

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals.

Representative examples of these quaternary softeners include ditallow ammonium chloride; ditallowdimethyl ammonium methyl sulfate; dihexadecyl dimethyl ammonium chloride; di(hydrogenated tallow) dimethyl ammonium methyl sulfate; dihexadecyl diethyl ammonium chloride; di(coconut) dimethyl ammonium chloride. Ditallow dimethyl ammonium chloride, di(hydrogenated tallow) dimethyl ammonium chloride, di(coconut) dimethyl ammonium chloride and di(coconut) dimethyl ammonium methosulfate are preferred.

Other preferred cationic compounds include those materials as disclosed in U.S. Pat. No. 4,767,547 corresponding to EP 239 910 (P&G), which is included herein by reference.

In this specification the expression hydrocarbyl group refers to alkyl or alkenyl groups optionally substituted or interrupted by functional groups such as —OH, —O—, —CONH, —COO—, etc.

Other preferred materials are the materials of the formula

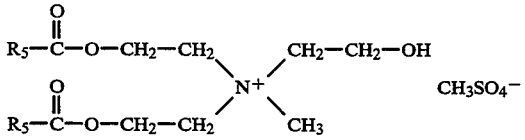

$R_5$ being tallow, which is available from Stepan under the tradename Stepantex VRH 90 and

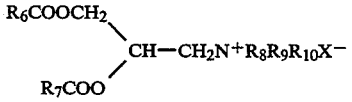

where $R_8$, $R_9$ and R10 are each alkyl or hydroxyalkyl groups containing from 1 to 4 carbon atoms, or a benzyl group. $R_6$ and $R_7$ are each an alkyl or alkenyl chain containing from 11 to 23 carbon atoms, and $X^-$ is a water soluble anion, substantially free of the corresponding monoester.

Another class of preferred water-insoluble cationic materials are the hydrocarbylimidazolinium salts believed to have the formula:

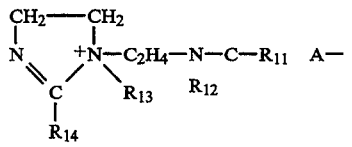

wherein $R_{13}$ is a hydrocarbyl group containing from 1 to 4, preferably 1 or 2 carbon atoms, $R_{11}$ is a hydrocarbyl group containing from 8 to 25 carbon atoms, $R_{14}$ is an hydrocarbyl group containing from 8 to 25 carbon atoms, $R_{14}$ is an hydrocarbyl group containing from 8 to 25 carbon atoms and $R_{12}$ is hydrogen or an hydrocarbyl containing from 1 to 4 carbon atoms and $A^-$ is an anion, preferably a halide, methosulfate or ethosulfate.

Preferred imidazolinium salts include 1-methyl-1-(tallowylamido-) ethyl -2-tallowyl- 4,5,-dihydroimidazolinium methosulfate and 1-methyl-1-(palmitoylamido) ethyl -2-octadecyl-4,5- dihydroimidazolinium chloride. Other useful imidazolinium materials are 2-heptadecul-1-methyl-1-(2-stearylamido)ethyl-imidazolinium chloride and 2-lauryl-1-hydroxyethyl-1-oleyl-imidazolinium chloride. Also suitable herein are the imidazolinium fabric softening components of U.S. Pat. No. 4 127 489, incorporated by reference.

Preferably the level of softening material in a composition according to the invention is from 1–75 weight %, preferably from 2–60% by weight more preferred from 2 to 15% by weight of the compositions. The fabric softener preferably constitutes from about 30% to about 94% by weight of the non-water constituents of the composition, more preferably from about 76% to about 94%.

The compositions may also contain preferably, in addition to the cationic fabric softener, other non-cationic fabric softeners, such as nonionic or amphoteric fabric softeners.

Suitable nonionic fabric softeners include glycerol esters, such as glycerol monostearate, fatty alcohols, such as stearyl alcohol, alkoxylated fatty alcohols $C_9$–$C_{24}$ fatty acids and lanolin and derivatives thereof. Suitable materials are disclosed in European Patent Applications 88 520 (Unilever PLC/NV case C1325, U.S. Pat. No. 4,555,349 corresponding to 122 141 (Unilever PLC/NV case C1363) and U.S. Pat. No. 4,454,049 corresponding to 79 746 (Procter and Gamble), the disclosures of which are incorporated herein by reference. Typically such materials are included at a level within the range of from 1–75%, preferably from 2–60%, more preferred from 2 to 15% by weight of the composition.

The compositions according to the invention may also contain preferably in addition to cationic fabric softening agents, one or more amines.

The term "amine" as used herein can refer to (i) amines of formula

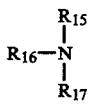

(I)

wherein $R_{15}$, $R_{16}$ and $R_{17}$ are defined as below;

(ii) amines of formula

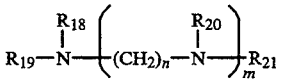

(II)

wherein $R_{18}$, $R_{19}$, $R_{20}$ and $R_{21}$, m and n are defined as below.

(iii) imidazolines of formula

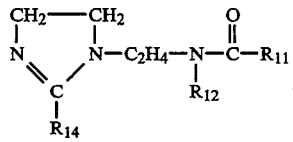

III wherein $R_{11}$, $R_{12}$ and $R_{14}$ are defined as above.

(iv) condensation products formed from the reaction of fatty acids with a polyamine selected from the group consisting of hydroxy alkylalkylenediamines and dialkylenetriamines and mixtures thereof. Suitable materials are disclosed in U.S. Pat. No. 4,661,269 corresponding to European Patent Application 199 382 (Procter and Gamble), incorporated herein by reference.

When the amine is of the formula I above, $R_{15}$ is a $C_6$ to $C_{24}$, hydrocarbyl group, $R_{16}$ is a $C_1$ to $C_{24}$ hydrocarbyl group and $R_{17}$ is a $C_1$ to $C_{10}$ hydrocarbyl group. Suitable amines include those materials from which the quaternary ammonium compounds disclosed above are derived, in which $R_{15}$ is $R_1$, $R_{16}$ is $R_2$ and $R_{17}$ is $R_3$. Preferably, the amine is such that both $R_{15}$ and $R_{16}$ are $C_6$–$C_{20}$ alkyl with $C_{16}$–$C_{18}$ being most preferred and with $R_{17}$ as $C_{1-3}$ alkyl, or $R_{15}$ is an alkyl or alkenyl group with at least 22 carbon atoms and $R_{16}$ and $R_{12}$ are $C_{1-3}$ alkyl. Preferably these amines are protonated with hydrochloric acid, orthophosphoric acid (OPA), $C_{1-5}$ carboxylic acids or any other similar acids, for use in the fabric conditioning compositions of the invention.

When the amine is of formula II above, $R_{18}$ is a $C_6$ to $C_{24}$ hydrocarbyl group, $R_{19}$ is an alkoxylated group of formula $-(CH_2CH_2O)_yH$, where y is within the range from 0 to 6, $R_{20}$ is an alkoxylated group of formula $-(CH_2CH_2O)_zH$ where z is within the range from 0 to 6, and is preferably 3. When m is O, it is preferred that $R_{18}$ is a $C_{16}$ to $C_{22}$ alkyl and that the sum total of z and y is within the range from 1 to 6, more preferably 1 to 3. When m is 1, it is preferred that $R_{18}$ is a $C_{16}$ to $C_{22}$ alkyl and that the sum total of x and y and z is within the range from 3 to 10.

Representative commercially available materials of this class include Ethomeen (ex Armour) and Ethoduomeen (ex Armour).

Preferably the amines of type (ii) or (iii) are also protonated for use in the fabric conditioning compositions of the invention.

When the amine is of type (iv) given above, a particularly preferred material is

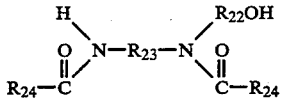

where $R_{22}$ and $R_{23}$ are divalent alkenyl chains having from 1 to 3 carbon atoms, and $R_{24}$ is an acyclic aliphatic hydrocarbon chain having from 15 to 21 carbon atoms.

A commercially available material of this class is Ceranine HC39 (ex Sandoz).

Mixtures of the amines may also be used. When present amine materials are typically included at a level within the range of from 1–75%, preferably 2–60% more preferred 2 to 15% by weight of the composition.

Optionally compositions according to the invention may also comprise one or more amine oxides of the formula:

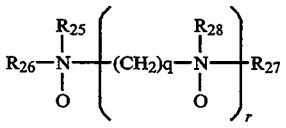

wherein $R_{25}$ is a hydrocarbyl group containing 8 to 24, preferably 10 to 22 carbon atoms, $R_{26}$ is an alkyl group containing 1 to 4 carbon atoms or a group of formula $-(CH_2CH_2O)_vH$, v is an integer from 1 to 6, $R_{27}$ is either $R_{25}$ or $R_{26}$, $R_{28}$ ir $R_{26}$, r is 0 of 1 and q is 3.

The invention is particularly advantageous if the amine oxide contains two alkyl or alkenyl groups each with at least 14 carbons atoms, such as dihardened tallow methyl amine oxide, or one alkyl or alkenyl group with at least 22 carbon atoms. When present such materials are typically included at a level of from 1–75, preferably 2–60 more preferred 2 to 15% by weight of the composition.

Preferably, the compositions of the invention contain substantially no anionic material, in particular no anionic surface active material. If such materials are present, the weight ratio of the cationic fabric softening agent to the anionic material should preferably be more than 5:1.

The composition can also contain one or more optional ingredients selected from non-aqueous solvents such as $C_1$–$C_4$ alkanols and polyhydric alcohols, pH buffering agents such as strong or weak acids e.g. HCl, $H_2SO_4$, phosphoric, benzoic or citric acid (the pH of the compositions are preferably less than 5.0), rewetting agents, viscosity modifiers such as electrolyutes, for example calcium chloride, antigelling agents, perfumes, perfume carriers, fluorescers, colourants, hydrotropes, antifoaming agents, antiredeposition agents, enzymes, optical brightening agents, opacifiers, stabilisers such as guar gum and polyethylene glycol, emulsifiers, anti-shrinking agents, anti-wrinkle agents, fabric crisping agents, anti-spotting agents, soil-release agents, germicides,-linear or branched silicones, fungicides, antioxidants, anti-corrosion agents, preservatives such as Bronopol (Trade Mark), a commercially available form of 2-bromo-2-nitropropane-1, 3-diol, dyes, bleaches and bleach precursors, drape imparting agents, antistatic agents and ironing aids.

These optional ingredients, if added, are each present at levels up to 5% by weight of the composition. The pH of the composition is preferably 5 or below, or adjusted thereto.

Fabric conditioning compositions according to the invention may be prepared by any conventional method for the preparation of dispersed softener systems. A well-known method for the preparation of such dispersed systems involves the preheating of the active ingredients, followed by formation of a pre-dispersion of this material in water of elevated temperature, and diluting said systems to ambient temperature systems.

The invention also provides a process for the manufacture of a shear-thinning fabric conditioner, comprising the steps of sequentially (a) forming an aqueous dispersion of a softener having a viscosity of less than the final viscosity; and (b) thickening the composition to a final viscosity by including a polymeric material comprising molecules with a hydrophilic backbone and at least two hydrophobic groups per molecule attached to the hydrophilic backbone, except where the polymeric material is a hydrophobically modified nonionic cellulose ether.

The final viscosity of the composition will be chosen in accordance with the end-use desired, but will generally be between 10 and 200 mPas, preferably between 20 and 120 mPas at 25° C. and 106 s-1.

In use, the fabric conditioning composition of the invention may be added to a large volume of water to form a liquor with which the fabrics to be treated are contacted. Generally, the concentration of the fabric softener, in this liquor will be between about 10 ppm and 1,000 ppm. The weight ratio of the fabrics to liquor will generally be between 40:1 and 4:1.

The invention will be further illustrated by means of the following examples.

EXAMPLE I

Basic fabric conditioner compositions of the following compositions were prepared by the following process (i) charge water into a mixing vessel, heat to 65° C. and add dye (ii) heat cationic/nonionic active materials to 70° C.

(iii) add heated active materials to water while stirring at 250 rpm (iv) cool the product and add the appropriate amount of thickener (v) add perfume and formalin.

| | Composition | |
|---|---|---|
| Ingredients | A % by weight | B % by weight |
| Arquad 2HT | 4.5 | 10.4 |
| Pristerine 4916 (ex Unichema) | — | 2.6 |
| Preservative | 0.02 | 0.02 |
| Colouring | 0.00055 | 0.00165 |
| Phosphoric acid | 0.03 | 0.04 |
| Magnesium chloride | | 0.02 |
| Perfume | 0.21 | 0.55 |
| Water | balance | |

| Ingredients | Composition C % by weight |
|---|---|
| Arquad 2HT | 2.1 |
| Non quaternised imidazoline[a] | 4.2 |
| Silicone[b] | 0.2 |
| Perfume, Dye, Preservative | 0.4 |
| Water | balance |

[a] = Rewopon 1255 ex Rewo

[b] = a di methyl poly siloxane having a viscosity of 100,000 cSt at $110S^{-1}$

| Ingredient | Composition D % by weight |
|---|---|
| Arquad 2HT | 3.43 |
| Pristerine 4916 | 0.51 |
| Formaldehyde | 0.08 |
| Colouring | 0.0018 |
| Perfume | 0.25 |

-continued

| | |
|---|---|
| Silicone[b] | 0.029 |
| Water | balance |

The viscosity of the products at 25° C. and 106 s-1 were measured in the presence and in the absence of 0.03% by weight of a polymeric thickener UCAR SCT 215 (ex Union Carbide), added in the form of a 25% solution as supplied.

The results were the following

| Composition | o% UCAR | viscosity in mPas 0.03% UCAR |
|---|---|---|
| A | 28 | 300 |
| B | 33 | 231 |
| C | 38.5 | 55.5 |
| D | 35 | 43 |

Based on the weight of the non-water constituents, the compositions include more than 30% by weight of cationic fabric softener.

Composition A comprises 4.76805% of non-water constituents. Of this, 4.5% is cationic fabric softener. Based on the non-water constituents, composition A comprises approximately 94% of cationic fabric softener.

From a similar calculation, Composition B comprises 13.63915% of non-water constituents, of which 10.4% is cationic fabric softener. Based on the non-water constituents, Composition B comprises approximately 76% of cationic fabric softener.

Similarly, Composition C comprises approximately 30% of cationic fabric softener and Composition D approximately 80% of cationic fabric softener based on the non-water constituents.

EXAMPLE 2

The viscosity of compositions D of Example I was measured after addition of various levels of UCAR SCT-215 or Acrysol RM-825 (polyurethane polymer ex Rohm and Haas added in the form of a 15% solution as supplied). Viscosities were measured in mPas at 25° C. at 110 s-1. The results were the following:

| Weight % polymer | viscosity (mPas 110s-1) |
|---|---|
| UCAR SCT-215 | |
| 0 | 33 |
| 0.02 | 38 |
| 0.04 | 63 |
| 0.06 | 92 |
| 0.10 | 145 |
| ACRYSOL RM-825 | |
| 0 | 34 |
| 0.02 | 34 |
| 0.04 | 43 |
| 0.06 | 52 |
| 0.10 | 77 |

We claim:

1. An aqueous fabric softening composition consisting essentially of

2–60% by weight of a fabric softener which is a cationic material with a solubility in water at pH 2.5 and 20° C. of less than 10 grams per liter;

0.008–0.3% by weight of a viscosity enhancing polymeric material having a molecular weight of 15,000 to 100,000 and selected from the group consisting of

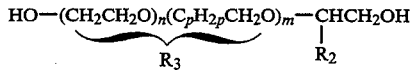

i)

or

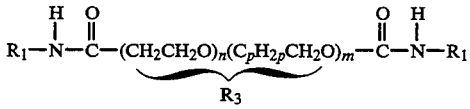

ii)

or

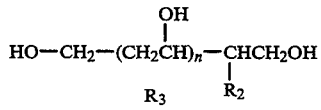

iii)

wherein p is 1 to 4, the sum of n and m is greater than 10 and if p is greater than 1, m is such that the group involved constitutes less than 50 mole %. $R_1$ is a $C_8$–$C_{24}$ linear or branched alkyl or alkenyl, $R_2$ is hydrogen or a $C_8$–$C_{24}$ linear or branched alkyl or alkenyl and $R_3$ is at least two $R_1$ groups which can be substituted at any $CH_2$ group along the polymer backbone;

0–60% by weight of a material selected from the group consisting of glycerol esters, fatty alcohols, alkoxylated fatty alcohols. $C_9$–$C_{24}$ fatty acids, lanolin, amines incorporating at least one $C_6$–$C_{25}$ hydrocarbyl group per molecule and amine oxides incorporating at least one $C_8$–$C_{24}$ hydrocarbyl group per molecule, said fabric softener constituting from 30% to 94% by weight of the non-water constituents of the composition provided that the polymeric material is not a hydrophobically modified nonionic cellulose ether.

2. A method for softening fabrics during laundering in a washing machine comprising the steps of:

rinsing fabrics with an aqueous liquor including a fabric softening composition comprising 2–60% by weight of a fabric softener which is a cationic material with a solubility in water at pH 2.5 and 20° C. of less than 10 grams per liter;

0.008–0.3% by weight of a viscosity enhancing polymeric material having a molecular weight of 15,000 to 100,000 and selected from the group consisting of

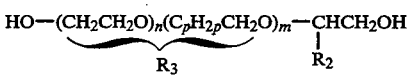

i)

or

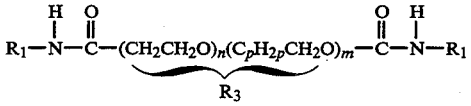

ii)

or

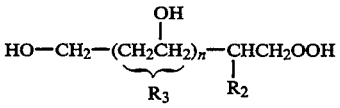

iii)

wherein p is 1 to 4, the sum of n and m is greater than 10 and if p is greater than 1, m is such that the group involved constitutes less than 50 mole %, $R_1$ is a $C_8$–$C_{24}$ linear or branched alkyl or alkenyl, $R_2$ is hydrogen or a $C_8$–$C_{24}$ linear or branched alkyl or alkenyl and $R_3$ is at least two $R_1$ groups which can be substituted at any $CH_2$ group along the polymer backbone;

0–60% of a material selected from the group consisting of glycerol esters, fatty alcohols, alkoxylated fatty alcohols, $C_9$–$C_{21}$ fatty acids, lanolin, amines incorporating at least one $C_6$–$C_{25}$ hydrocarbyl group per molecule and amine oxides incorporating at least one $C_8$–$C_{24}$ hydrocarbyl group per molecule;

said fabric softener constituting from 30% to 94% by weight of the non-water constituents of the composition, provided that the polymeric material is not a hydrophobilcally modified nonionic cellulose ether, to soften the fabrics.

* * * * *